US006563402B2

(12) United States Patent
Kundu

(10) Patent No.: US 6,563,402 B2
(45) Date of Patent: May 13, 2003

(54) BAND PASS FILTER

(75) Inventor: Arun Chandra Kundu, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/870,441

(22) Filed: May 30, 2001

(65) Prior Publication Data

US 2002/0101305 A1 Aug. 1, 2002

(30) Foreign Application Priority Data

Nov. 29, 2000 (JP) ..... 2000-363464
Apr. 6, 2001 (JP) ..... 2001-108742

(51) Int. Cl.[7] ..... H01P 1/20; H01P 1/219

(52) U.S. Cl. ..... 333/202; 333/210; 333/212

(58) Field of Search ..... 333/210, 202, 333/204, 219.1, 203, 134, 212

(56) References Cited

U.S. PATENT DOCUMENTS 4,837,535 A * 6/1989 Konishi et al. ..... 333/210
6,002,306 A * 12/1999 Arakawa ..... 333/134
6,137,383 A * 10/2000 De Lillo ..... 333/210
6,154,106 A * 11/2000 De Lillo ..... 333/210

FOREIGN PATENT DOCUMENTS

JP 2001-257503 * 9/2001 ..... H01P/1/201

OTHER PUBLICATIONS

Arun Chandra Kundu and Ikuo Awai, "Low–Profile Dual–Mode BPF Using Square Dielectric Disk Resonator," (Proceedings of the 1997 Chugoku–Region Autumn Joint Conference of 5 Institutes) p. 272, Oct. 1997, Japan.

Arun Chandra Kundu and Kenji Endou, "TEM–Mode Planar Dielectric Waveguide Resonator BPF for W–CDMA," (IEEE International Microwave Symposium Digest 2000), vol. 1, pp. 191–194, Jun. 2000.

Yoshihro Konishi, "Novel Dielectric Waveguide Components—Microwave Applications of New Ceramic Materials," (Proceedings of the IEEE), vol. 79, pp. 726–740 Jun. 1991.

Ikuo Awai and Arun Chandra Kundu, "Distributed Coupling of Dual–Modes in a Circular Resonator and Low–Profile Dielectric Disk Resonator BPF," (IEICE Trans. on Electronics), vol. E82–C, No. 2, pp. 393–401, Feb. 1999.

Ingo Wolff and Norbert Knoppik, "Rectangular and Circular Microstrip Disk Capacitors and Resonators," (IEEE Trans. on MTT), vol. MTT–22, No. 10, pp. 857–864, Oct. 1974.

J. Watkins, "Radiation Loss from Open–Circuited Dielectric Resonators," (IEEE Trans. on MTT), pp. 636–639, Oct. 1973.

(List continued on next page.)

*Primary Examiner*—Robert Pascal
*Assistant Examiner*—Dean Takaoka
(74) *Attorney, Agent, or Firm*—Brown Raysman Millstein Felder & Steiner, LLP

(57) ABSTRACT

A highly compact band pass filter that reliably achieves desired characteristic is disclosed. A band pass filter according to the present invention employs first and second disk resonators having exciting electrodes formed on one side surface thereof, an evanescent waveguide interposed between the first and second disk resonators, and a capacitive stub formed on other side surfaces of the first and second disk resonators. The capacitive stub reduces the size of the band pass filter because a resonant frequency of the disk resonators is lowered by the capacitive stub. Further, the capacitive stub enhances the mechanical strength of the band pass filter because a coupling constant k between the disk resonators is lowered by the capacitive stub.

18 Claims, 16 Drawing Sheets

OTHER PUBLICATIONS

J. Watkins and H. Mirghani, "Radiation Loss from Open-Circuited Rectangular Dielectric Resonators Operating in Double–Integer Modes," (International Journals Electronics), vol. 37, No. 5, pp. 689–703, 1974.

L.S. Napoli and J.J. Huges, "A Simple Technique for the Accurate Determination of the Microwave Dielectric Constant for Microwave Integrated Circuit Substrates," (IEEE Trans. on MTT), pp. 664–665, Jul. 1971.

Tor Dag Iveland, "Dielectric Resonator Filters for Application in Microwave Integrated Circuits," (IEEE Trans. on MTT), vol. MTT–19, No. 7, pp. 643–652, Jul. 1971.

M.V. Schneider, "Microstrip Lines for Microwave Integrated Circuits," (The Bell System Technical Journal), pp. 1421–1444, Jun. 1969.

* cited by examiner

BAND PASS FILTER

BACKGROUND OF THE INVENTION

The present invention relates to a band pass filter, and particularly, to a highly compact band pass filter that reliability achieves desired characteristics.

DESCRIPTION OF THE PRIOR ART

In recent years, marked advances in miniaturization of communication terminals, typically mobile phones, has been achieved thanks to miniaturization of the various components incorporated therein. One of the most important components incorporated in a communication terminal is a filter component. As a filter component, a band pass filter described in "Low-Profile Dual-Mode BPF Using Square Dielectric Disk Resonator (Proceeding of the 1997 Chugoku-region Autumn Joint Conference of 5 Institutes, p272, 1997)" is known.

The band pass filter described in this paper is constituted of a TEM dual-mode dielectric disk resonator. This dielectric disk resonator measures 5 mm×5 mm in plan view and its upper and lower surfaces are coated with silver plates. The silver plate on the upper surface is electrically floated whereas the silver plate on the lower surface is grounded. A dielectric material whose dielectric constant $\in r=93$ is interposed between these two silver plates. All of the side surfaces of the dielectric resonator are open to the air. Thus, electric field is maximum (+ve or −ve) throughout the wall of the resonator. The electric field should be minimum at the symmetry plane of the resonator. For this reason, this type of dielectric resonator is call a half-wave ($\lambda/2$) dielectric disk resonator.

FIG. 1 is a graph showing a theoretical characteristic curve of the relationship between the thickness of the dielectric resonator described in the paper and unloaded quality factor ($Q_0$), together with experimentally obtained values.

As shown in FIG. 1, the unloaded quality factor ($Q_0$) of the dielectric resonator is maximum (≈250 (experimental value)) when the thickness thereof is 1 mm. Thus in this type of the dielectric resonator, the unloaded quality factor ($Q_0$), a parameter indicating performance, depends on the thickness of the dielectric resonator.

In contrast, the resonant frequency of the dielectric resonator depends on the size of its plan view. For example, if the dielectric resonator set out in the above-mentioned paper is fabricated to have a resonant frequency of 2 GHz, the dimension of the resonator become 8.5 mm×8.5 mm×1 mm. Thus, a band pass filter formed using such a dielectric resonator is large.

As a need continues to be felt for still further miniaturization of communication terminals such as mobile phones, further miniaturization of filter components, e.g., band pass filters, incorporated therein is also required.

However, it is extremely difficult to miniaturize filter components while still achieving the required characteristics because, as explained in the foregoing, the characteristics thereof (such as unloaded quality factor ($Q_0$) and resonant frequency) depend on filter size.

SUMMARY OF THE INVENTION

It is therefore an object of the present invention to provide a compact band pass filter having desired characteristics.

The above and other objects of the present invention can be accomplished by a band pass filter comprising: a first resonator of disk-shape having an input terminal formed on one side surface thereof, a second resonator of disk-shape having an output terminal formed on one side surface thereof, an evanescent waveguide interposed between the first and the second resonators, and a capacitive stub having a first portion formed on another side surface of the first resonator and a second portion formed on another side surface of the second resonator.

According to this aspect of the present invention, because the resonant frequencies of the first and the second resonators are lowered by the capacitive stub, the overall size of the band pass filter can be reduced compared with the size that would otherwise be determined by the resonant frequencies of the first and second resonators. Moreover, because the coupling constant between the first and second resonators is lowered by the capacitive stub, the thickness of the evanescent waveguide can be thickened compared with that it would otherwise have, so that the mechanical strength of the band pass filter is enhanced. Further, the capacitive stub reduces the effect of unnecessary higher mode resonation of the band pass filter.

In a preferred aspect of the present invention, the band pass filter further comprises a metal plate formed on a side surface of the evanescent waveguide, thereby connecting a first portion of the capacitive stub and a second portion of the capacitive stub.

In a further preferred aspect of the present invention, the first portion of the capacitive stub and the second portion of the capacitive stub have the same dimensions.

In a further preferred aspect of the present invention, the capacitive stub further has a third portion formed on the one side surface of the first resonator and a fourth portion formed on the one side surface of the second resonator.

According to this preferred aspect of the present invention, the overall size of the band pass filter can be further reduced and the mechanical strength of the band pass filter can be further enhanced.

The above and other objects of the present invention can be also accomplished by a band pass filter comprising:

- first and second dielectric blocks each of which has a top surface, a bottom surface, first and second side surfaces opposite to each other, and third and fourth side surfaces opposite to each other;
- a third dielectric block in contact with the first side surface of the first dielectric block and the first side surface of the second dielectric block;
- metal plates formed on the top surfaces, the bottom surfaces, and the second side surfaces of the first and second dielectric blocks;
- a first electrode formed on the third side surface of the first dielectric block;
- a second electrode formed on the third side surface of the second dielectric block;
- a first capacitive stub formed on the fourth side surface of the first dielectric block; and
- a second capacitive stub formed on the fourth side surface of the second dielectric block.

According to this aspect of the present invention, because the resonant frequencies of the two resonators constituted by the first and second dielectric blocks are reduced by the first and the second capacitive stubs, the overall size of the band pass filter can be reduced compared with the size that would otherwise be determined by the resonant frequencies of the resonators. Moreover, because the coupling constant between the resonators is lowered by the first and second capacitive stubs, the thickness of the evanescent waveguide constituted by the third dielectric block can be thickened compared with the thickness it would otherwise have, so that the mechanical strength of the band pass filter is enhanced. Further, the radiation loss arising at the fourth side surfaces of the first dielectric block and the fourth side surface of the second dielectric block is reduced by the first and the second capacitive stubs. Furthermore, the first and second capacitive stubs reduces the effect of the unnecessary higher mode resonation of the band pass filter.

In a preferred aspect of the present invention, the first dielectric block and the second dielectric block have the same dimensions.

In a further preferred aspect of the present invention, the first capacitive stub is in contact with the metal plate formed on the bottom surface of the first dielectric block, and the second capacitive stub is in contact with the metal plate formed on the bottom surface of the second dielectric block.

In a further preferred aspect of the present invention, the first capacitive stub and the second capacitive stub have the same dimensions.

In a further preferred aspect of the present invention, the third dielectric block has a first side surface in contact with the first side surface of the first dielectric block, a second side surface in contact with the first side surface of the second dielectric block, a third side surface parallel to the third side surface of the first dielectric block, a fourth side surface parallel to the fourth side surface of the first dielectric block, a top surface parallel to the top surface of the first dielectric block, and a bottom surface parallel to the bottom surface of the first dielectric block on which a metal plate is formed.

In a further preferred aspect of the present invention, the bottom surfaces of the first to third dielectric blocks are coplanar.

In a further preferred aspect of the present invention, the third side surface of the first dielectric block and the third side surface of the third dielectric block are coplanar, and the fourth side surface of the first dielectric block and the fourth side surface of the third dielectric block are coplanar.

In a further preferred aspect of the present invention, the third side surface of the first dielectric block and the third side surface of the second dielectric block are coplanar, and the fourth side surface of the first dielectric block and the fourth side surface of the second dielectric block are coplanar.

In a further preferred aspect of the present invention, a metal plate is formed on the fourth side surface of the third dielectric block thereby integrating the first capacitive stub, the second capacitive stub, and the metal plate formed on the fourth side surface of the third dielectric block.

In a further preferred aspect of the present invention, the third side surface of the first dielectric block and the fourth side surface of the second dielectric block are coplanar, and the fourth side surface of the first dielectric block and the third side surface of the second dielectric block are coplanar.

In a further preferred aspect of the present invention, the band pass filter further comprises a third capacitive stub formed on the fourth side surface of the first dielectric block and a fourth capacitive stub formed on the fourth side surface of the second dielectric block.

According to this preferred aspect of the present invention, the overall size of the band pass filter can be further reduced and the mechanical strength of the band pass filter can be further enhanced.

In a further preferred aspect of the present invention, the first electrode is in contact with the metal plate formed on the top surface of the first dielectric block, and the second electrode is in contact with the metal plate formed on the top surface of the second dielectric block.

In a further preferred aspect of the present invention, the first dielectric block and the metal plates formed on the top surface, bottom surface and second side surface thereof constitute a quarter-wave ($\lambda/4$) dielectric resonator, and the second dielectric block and the metal plates formed on the top surface, bottom surface and second side surface thereof constitute another quarter-wave ($\lambda/4$) dielectric resonator.

In a further preferred aspect of the present invention, an end of the first capacitive stub is positioned at a center of the fourth side surface of the first dielectric block, and an end of the second capacitive stub is positioned at a center of the fourth side surface of the second dielectric block.

According to this preferred aspect of the present invention, because the first and second capacitive stubs are formed at regions of the fourth side surfaces of the first and second dielectric blocks where the electric field is relatively strong, marked effects of lowering resonant frequency, thickening the evanescent waveguide constituted by the third dielectric block, reducing radiation loss, and reducing the effect of the unnecessary higher mode resonation are obtained.

The above and other objects of the present invention can be also accomplished by a band pass filter comprising:

first and second dielectric blocks each of which has a top surface, a bottom surface, first and second side surfaces opposite to each other, and third side surface perpendicular to the first side surface;

a third dielectric block in contact with the first side surface of the first dielectric block and the first side surface of the second dielectric block;

metal plates formed on the top surfaces, bottom surfaces, and second side surfaces of the first and second dielectric blocks;

a first electrode formed on the third side surface of the first dielectric block; and a second electrode formed on the third side surface of the second dielectric block, a coupling capacitance being established between a first resonation circuit formed between the first electrode and the metal plates and a second resonation circuit formed between the second electrode and the metal plates, the band pass filter further comprising:

means for providing an additional capacitance in parallel with the first resonation circuit and another additional capacitance in parallel with the second resonation circuit.

DESCRIPTION OF THE PREFERRED EMBODIMENTS

Preferred embodiments of the present invention will now be explained with reference to the drawings.

Figure 1:
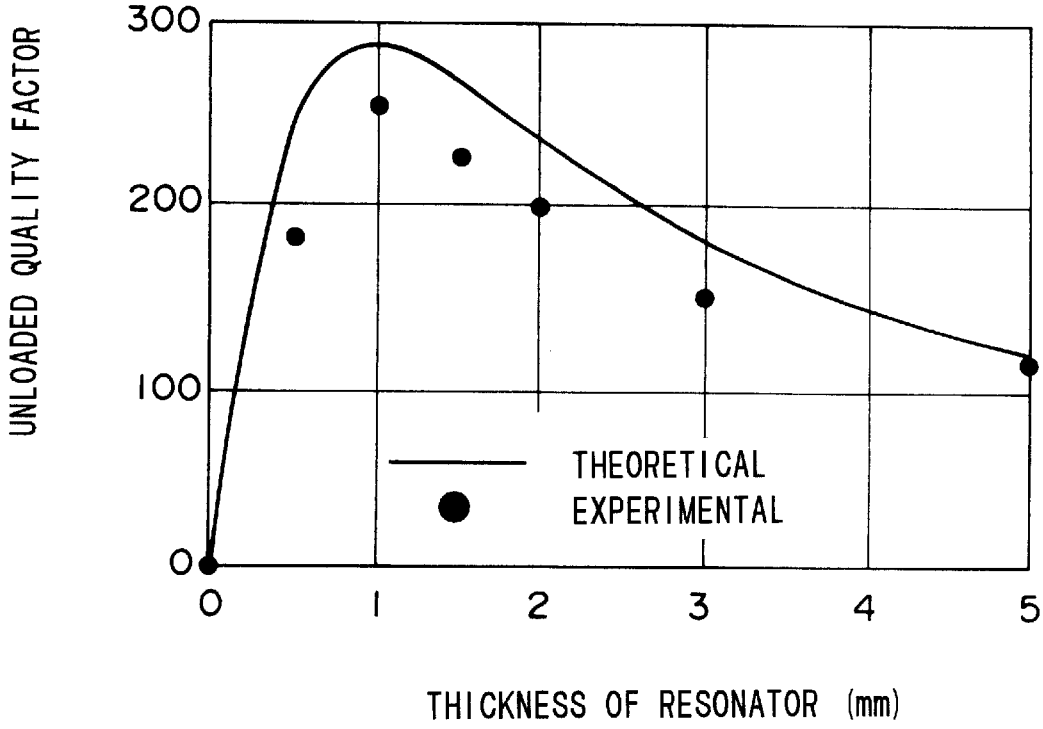
FIG. 1 is a graph showing a theoretical characteristic curve of the relationship between the thickness of a dielectric resonator described in the paper and unloaded quality factor ($Q_0$), together with experimentally obtained values.
Figure 2:
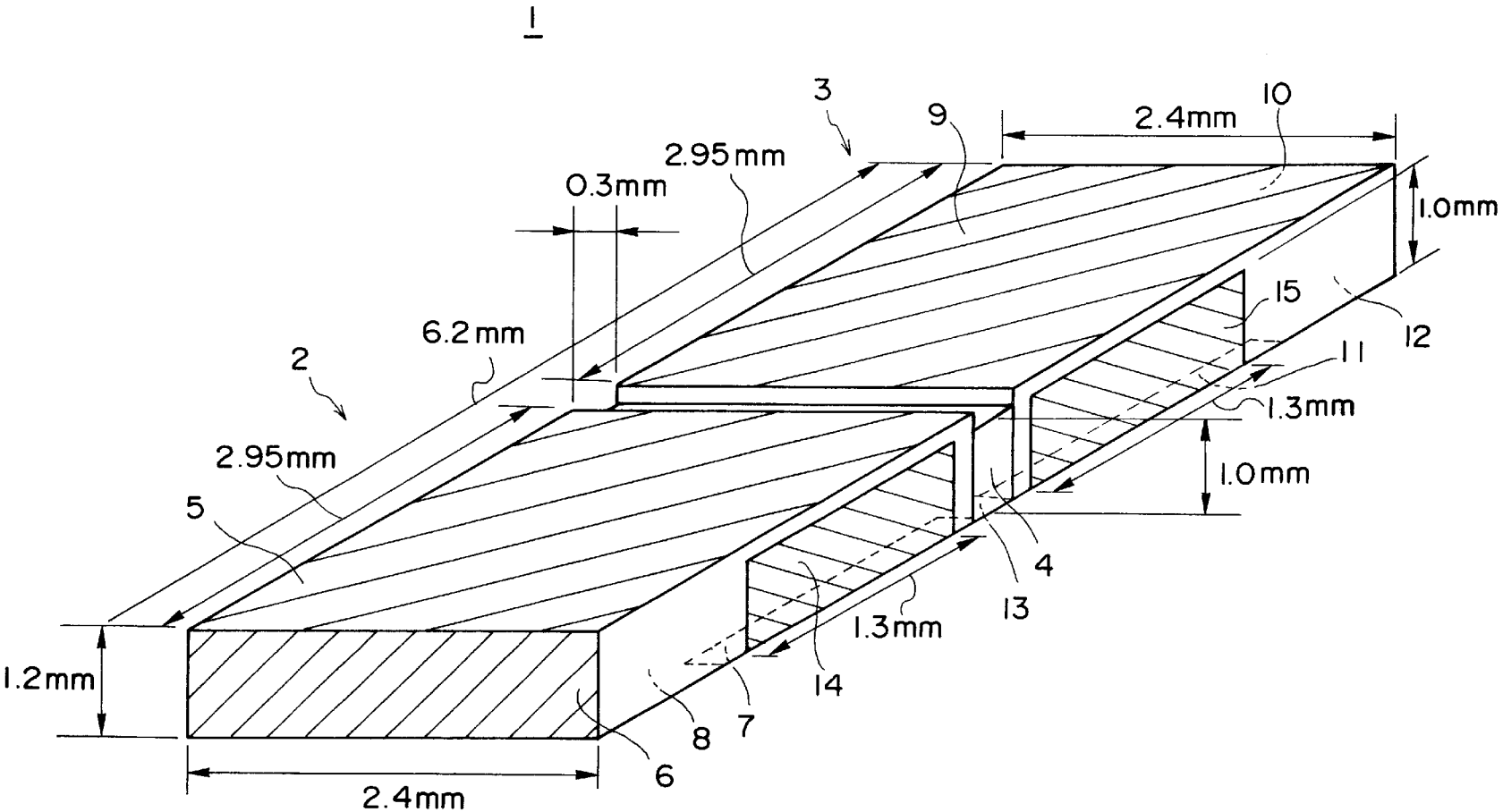
FIG. 2 is a schematic perspective view from one side showing a band pass filter 1 that is a preferred embodiment of the present invention.
Figure 3:
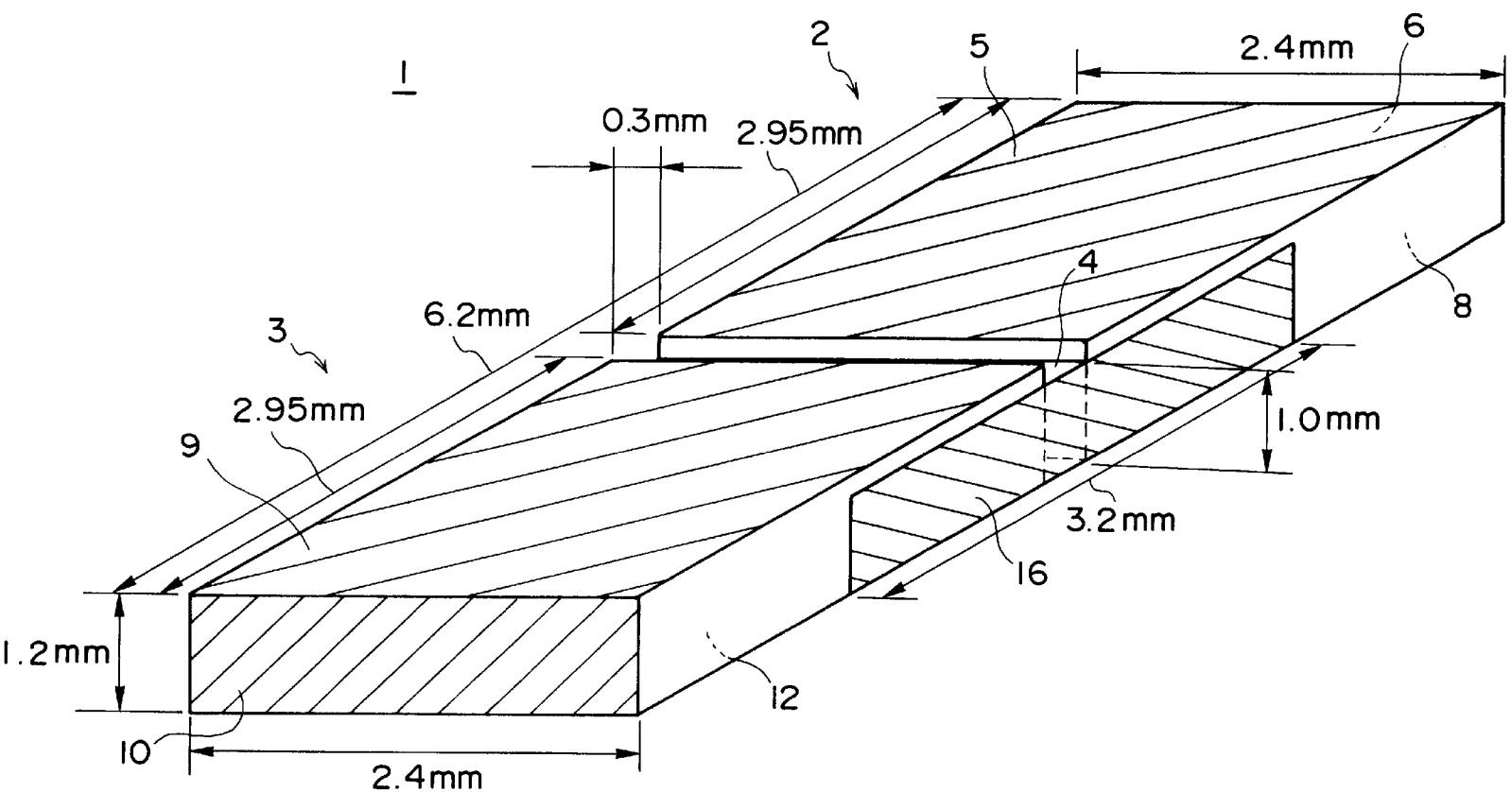
FIG. 3 is a schematic perspective view from the opposite side showing the band pass filter of FIG. 2.
Figure 4:
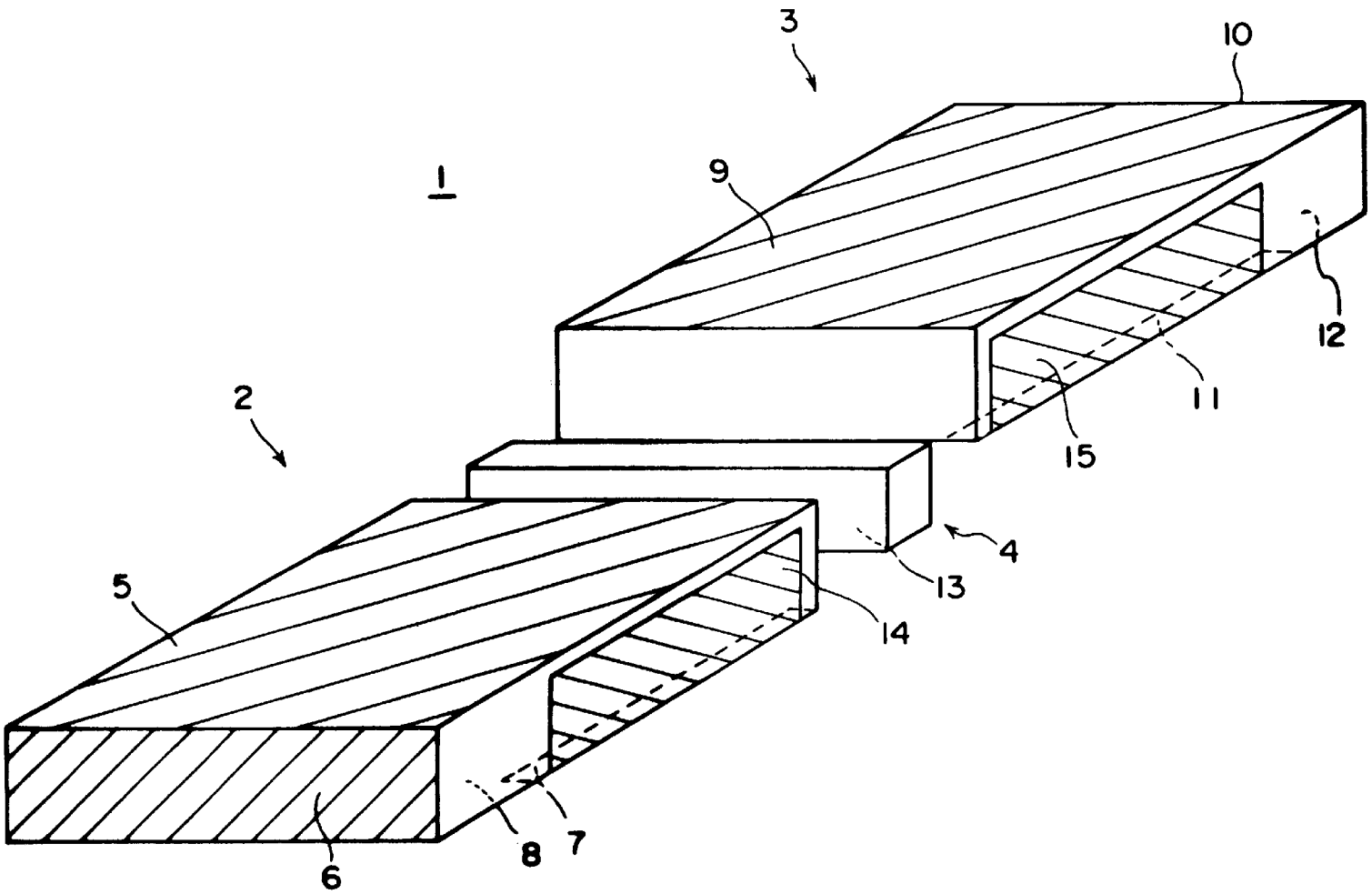
FIG. 4 is an exploded schematic perspective view showing the band pass filter of FIG. 2.

As shown in FIGS. 2 to 4, a band pass filter 1 that is a preferred embodiment of the present invention is constituted of a first resonator 2, a second resonator 3, and an evanescent waveguide 4 interposed between the first and second resonators 2 and 3.

The first resonator 2 and the second resonator 3 are symmetrical. Each is composed of a dielectric block whose length, width, and thickness are 2.95 mm, 2.4 mm, and 1.2 mm. These dielectric blocks are made of dielectric material whose dielectric constant $\in r$ is relatively high, i.e., $\in r=93$. The evanescent waveguide 4 is composed of a dielectric block whose length, width, and thickness are 0.3 mm, 2.4 mm, and 1.0 mm. It is made of the same dielectric material as the dielectric blocks composing the first and second resonators 2 and 3. Thus, the band pass filter 1 measures 6.2 mm, 2.4 mm, and 1.2 mm in length, width, and thickness.

The first resonator 2, the second resonator 3, and the evanescent waveguide 4 are combined such that their bottom surfaces are coplanar.

In this specification, the surfaces opposite to the associated bottom surfaces of the dielectric blocks composing the first resonator 2, the second resonator 3, and the evanescent waveguide 4 are each defined as a "top surface." Among the surfaces of the dielectric blocks composing the first and the second resonators 2 and 3, each surface in contact with the evanescent waveguide 4 is defined as a "first side surface." Among the surfaces of the dielectric blocks composing the first and the second resonators 2 and 3, each surface opposite to the first side surface is defined as a "second side surface." The remaining surfaces of the dielectric blocks composing the first and second resonators 2 and 3 are defined as a "third side surface" and a "fourth side surface" with respect to each block. Among the surfaces of the dielectric block composing the evanescent waveguide 4, the surface in contact with the first side surface of the first resonator 2 is defined as a "first side surface." Among the surfaces of the dielectric block composing the evanescent waveguide 4, the surface in contact with the first side surface of the second resonator 3 is defined as a "second side surface." The remaining surfaces of the dielectric block composing the evanescent waveguide 4 are defined as a "third side surface" and a "fourth side surface." Therefore, "length," "width," and "thickness" of the first resonator 2, the second resonator 3, and the evanescent waveguide 4 are defined by the distance between the first and second side surfaces, the distance between the third and fourth side surfaces, and the distance between the top and bottom surfaces, respectively. The third side surfaces of the first resonator 2, second resonator 3, and evanescent waveguide 4 are coplanar, and these fourth side surfaces of the first resonator 2, second resonator 3, and evanescent waveguide 4 are also coplanar.

As shown in FIGS. 2 to 4, metal plates 5 and 6 are formed on the entire top surface and entire second side surface of the first resonator 2 and a metal plate 8 is formed on the bottom surface of the first resonator 2 except at a clearance portion 7. These metal plates 5, 6, and 8 are short-circuited with one another. Similarly, metal plates 9 and 10 are formed on the entire top surface and entire second side surface of the second resonator 3 and a metal plate 12 is formed on the bottom surface of the second resonator 3 except at a clearance portion 11. These metal plates 9, 10, and 12 are short-circuited with one another. A metal plate 13 is formed on the entire bottom surface of the evanescent waveguide 4. These metal plates 5, 6, 8, 9, 10, 12, and 13 are thus short-circuited with one another and grounded.

As shown in FIGS. 2 and 4, an exciting electrode 14 whose height and width are 1 mm and 1.3 mm is formed on the third side surface of the first resonator 2 where the clearance portion 7 prevents the exciting electrode 14 from being in contact with the metal plate 8 formed on the bottom surface. Similarly, an exciting electrode 15 whose height and width are 1 mm and 1.3 mm is formed on the third side surface of the second resonator 3 where the clearance portion 11 prevents the exciting electrode 15 from being in contact with the metal plate 12 formed on the bottom surface. One of the exciting electrodes 14 and 15 is used as an input electrode, and the other is used as an output electrode.

As shown in FIG. 3, a capacitive stub 16 whose height and width are 1 mm and 3.2 mm is formed on the fourth side surfaces of the first resonator 2, second resonator 3, and evanescent waveguide 4. The capacitive stub 16 is connected to the metal plate 8 formed on the bottom surface of the first resonator 2, the metal plate 12 formed on the bottom surface of the second resonator 3, and the metal plate 13 formed on the bottom surface of the evanescent waveguide 4. The capacitive stub 16 is symmetrical with respect to the center of the evanescent waveguide 4 so that a part of the capacitive stub 16 which is part of the first resonator 2 and another part of the capacitive stub 16 which is part of the second resonator 3 have the same dimensions.

The metal plates 5, 6, 8, 9, 10, 12, and 13, the exciting electrodes 14 and 15, and the capacitive stub 16 are made of silver. However, the present invention is not limited to using silver and other kinds of metal can be used instead.

No electrode is formed on the remaining surfaces of the first resonator 2, second resonator 3, and evanescent waveguide 4, which therefore constitute open ends.

Each of the first resonator 2 and the second resonator 3 having the above described structure acts as a quarter-wave (λ/4) dielectric resonator. The evanescent waveguide 4 having the above-described structure acts as an E-mode waveguide.

The principle of the quarter-wave (λ/4) dielectric resonators constituted by the first resonator 2 and the second resonator 3 will now be explained.

Figure 5:
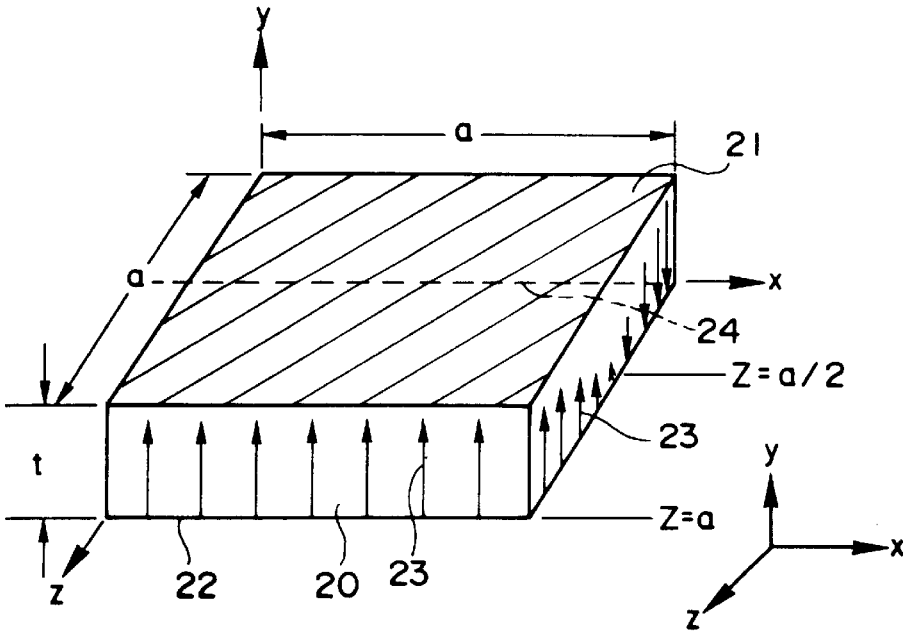
FIG. 5 is a schematic perspective view showing an ordinary TEM-mode planer type half-wave ($\lambda/2$) dielectric resonator.

FIG. 5 is a schematic perspective view showing an ordinary TEM-mode planer type half-wave (λ/2) dielectric resonator.

As shown in FIG. 5, the ordinary half-wave (λ/2) dielectric resonator is constituted of a dielectric block 20, a metal plate 21 formed on the upper surface of the dielectric block 20, and a metal plate 22 formed on the lower surface of the dielectric block 20. The metal plate formed on the upper surface of the dielectric block 20 is electrically floated whereas the metal plate 22 formed on the lower surface of the dielectric block 20 is grounded. All of the four side surfaces of the dielectric block 20 are open to the air. In FIG. 5, the length and width of the dielectric block 20 are indicated by a and t.

For propagation of the dominant TEM-mode along the z direction of this half-wave (λ/2) dielectric resonator, if electric field is negative maximum at z=0 plan, then it should be positive maximum at z=a plan as indicated by the arrow 23 in this Figure. Definitely there should be minimum (zero) electric field at z=a/2 plan, which is the symmetry plan 24 of the resonator.

Cutting such a half-wave (λ/2) dielectric resonator along the symmetrical plan 24, two quarter-wave (λ/4) dielectric resonators can be obtained. In this quarter-wave (λ/4) dielectric resonator, a plan z=a/2 acts as a perfect electric conductor (PEC).

Figure 6:
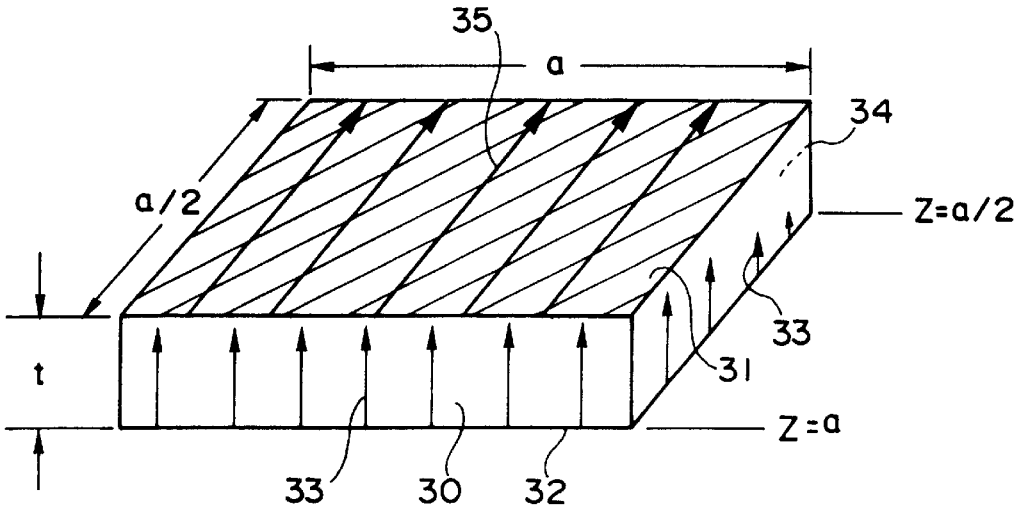
FIG. 6 is a schematic perspective view showing an ordinary TEM-mode planer type quarter-wave (λ/4) dielectric resonator.

FIG. 6 is a schematic perspective view showing the quarter-wave (λ/4) dielectric resonator obtained by above described method.

As shown in FIG. 6, the quarter-wave (λ/4) dielectric resonator is constituted of a dielectric block 30, a metal plate 31 formed on the upper surface of the dielectric block 30, a metal plate 32 formed on the lower surface of the dielectric block 30, and a metal plate 34 formed on one of the side surfaces of the dielectric block 30. The remaining three side surfaces of the dielectric block 30 are open to the air. The metal plate 32 formed on the lower surface of the dielectric block 30 is grounded. The metal plate 34 formed on one of the side surfaces of the dielectric block 30 corresponds to the perfect electric conductor (PEC) of the half-wave (λ/2) dielectric resonator to short-circuit the metal plate 31 and the metal plate 32. In FIG. 6, arrows 33 indicate electric field, and arrows 35 indicate current flow.

Ideally, the quarter-wave (λ/4) dielectric resonator shown in FIG. 6 and the half-wave (λ/2) dielectric resonator shown in FIG. 5 should have the same resonant frequency. If a material having a relatively high dielectric constant is used for the dielectric block 30, electromagnetic field confinement inside the resonator is adequately strong. Moreover, the distribution of the electromagnetic field of the quarter-wave (λ/4) dielectric resonator becomes substantially the same as that of the half-wave (λ/2) dielectric resonator. As shown in FIGS. 5 and 6, the volume of the quarter-wave (λ/4) dielectric resonator is half the volume of the half-wave (λ/2) dielectric resonator. As a result, the total energy of the quarter-wave (λ/4) dielectric resonator is also half the total energy of the half-wave (λ/2) dielectric resonator. However, the unloaded quality factor ($Q_0$) of the quarter-wave (λ/4) dielectric resonator remain almost same that of the half-wave (λ/2) dielectric resonator because the energy loss of the quarter-wave (λ/4) dielectric resonator decreases to around 50% that of the half-wave (λ/2) dielectric resonator. The quarter-wave (λ/4) dielectric resonator therefore enables miniaturization without substantially changing the resonant frequency and the unloaded quality factor ($Q_0$).

Specifically, as mentioned regarding the prior art, if a band pass filter whose resonant frequency is 2 GHz is used to fabricate half-wave (λ/2) dielectric resonators, the size dimension of the resonators becomes 8.5 mm×8.5 mm×1.0 mm. A quarter-wave (λ/4) dielectric resonator measuring 8.5 mm×4.25 mm×1.0 mm can therefore be obtained by cutting the half-wave (λ/2) dielectric resonator. However, the resonant frequency of the 8.5 mm×4.25 mm×1.0 mm quarter-wave (λ/4) dielectric resonator becomes slightly lower than that of the 8.5 mm×8.5 mm×1.0 mm half-wave (λ/2) dielectric resonator because the metal plate 34 formed on one of the side surfaces of the dielectric block 30 of quarter-wave (λ/4) dielectric resonator contributes additional series inductance to the resonance circuit.

Figure 7:
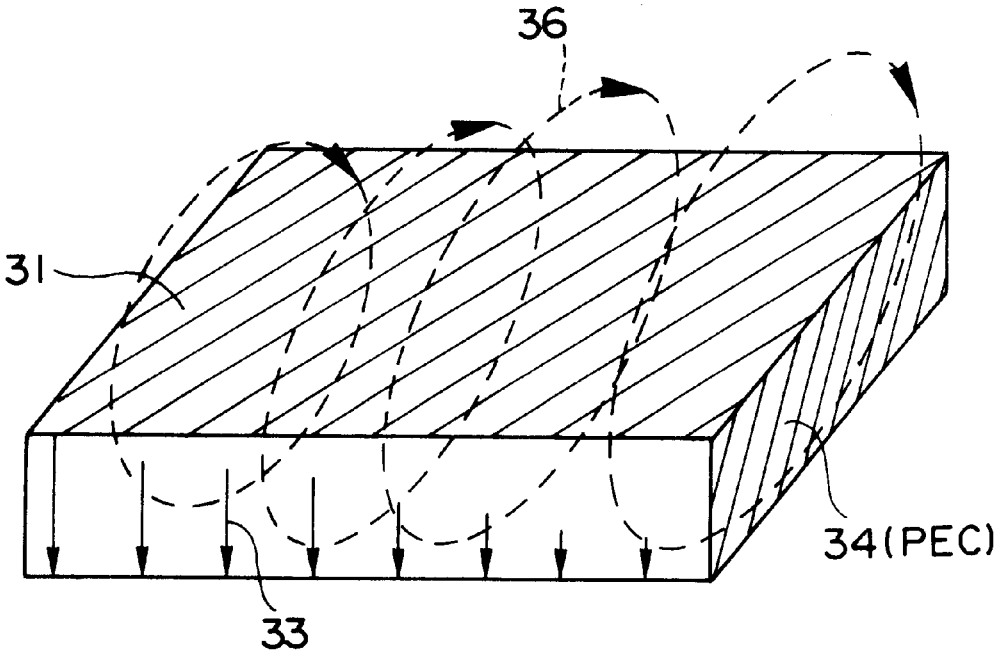
FIG. 7 is a schematic diagram for explaining an electric field and a magnetic field generated by a quarter-wave (λ/4) dielectric resonator.

FIG. 7 is a schematic diagram for explaining the electric field and the magnetic field generated by the quarter-wave (λ/4) dielectric resonator.

As shown in FIG. 7, the magnetic field 36 of the quarter-wave (λ/4) dielectric resonator is maximum throughout the metal plate 34 formed on one of the side surfaces of the dielectric block 30. By linking the metal plate 34, the magnetic field 36 causes the additional serial inductance to change the resonant frequency. The resonant frequency of the quarter-wave (λ/4) dielectric resonator therefore becomes slightly lower than that of the half-wave (λ/2) dielectric resonator. In an experiment, resonant frequency of 1.9 GHz, which is 55 MHz lower than the resonant frequency of the half-wave (λ/2) dielectric resonator of 8.5 mm×8.5 mm×1.0 mm, was obtained with the quarter-wave (λ/4) dielectric resonator of 8.5 mm×4.25 mm×1.0 mm.

Although the unloaded quality factor ($Q_0$) depends on the thickness of the dielectric block as explained above, in the quarter-wave (λ/4) dielectric resonator, the unloaded quality factor ($Q_0$) depends on not only the thickness thereof but also the width thereof. Specifically, the unloaded quality factor ($Q_0$) of the quarter-wave (λ/4) dielectric resonator increases in proportion to the width of the dielectric block in a first width region of the dielectric block smaller than a predetermined width and becomes substantially constant in a second width region of the dielectric block greater than the predetermined width.

A quarter-wave (λ/4) dielectric resonator having the desired unloaded quality factor ($Q_0$) can therefore be obtained by optimizing the thickness and the width of the dielectric block constituting the quarter-wave (λ/4) dielectric resonator. For example, to obtain a quarter-wave (λ/4) dielectric resonator having an unloaded quality factor ($Q_0$) of approximately 240, the thickness and the width of the dielectric block should be set at approximately 1.0 mm×3.0 mm in the case of a quarter-wave (λ/4) dielectric resonator having a resonant frequency of approximately 1.945 GHz and at approximately 1.2 mm×2.4 mm in the case of a quarter-wave (λ/4) dielectric resonator having a resonant frequency of approximately 2.458 GHz.

Further, in this type of quarter-wave (λ/4) dielectric resonator, the resonant frequency mainly depends on the length of the dielectric block but has very little dependence upon width and thickness of the resonator. Specifically, the resonant frequency increases with shorter length of the dielectric block.

A quarter-wave (λ/4) dielectric resonator having the desired resonant frequency can therefore be obtained by optimizing the length of the dielectric block constituting the quarter-wave (λ/4) dielectric resonator. For example, to obtain a quarter-wave (λ/4) dielectric resonator having a resonant frequency of approximately 1.945 GHz, the length of the dielectric block should be set at approximately 4.25 mm and to obtained one having a resonant frequency of approximately 2.458 GHz, the length of the dielectric block should be set at approximately 3.55 mm.

The band pass filter 1 of this embodiment is constituted of two quarter-wave (λ/4) dielectric resonators, whose operating principle was explained in the foregoing, and an evanescent waveguide 4 which acts as an E-mode waveguide disposed therebetween.

Figure 8:
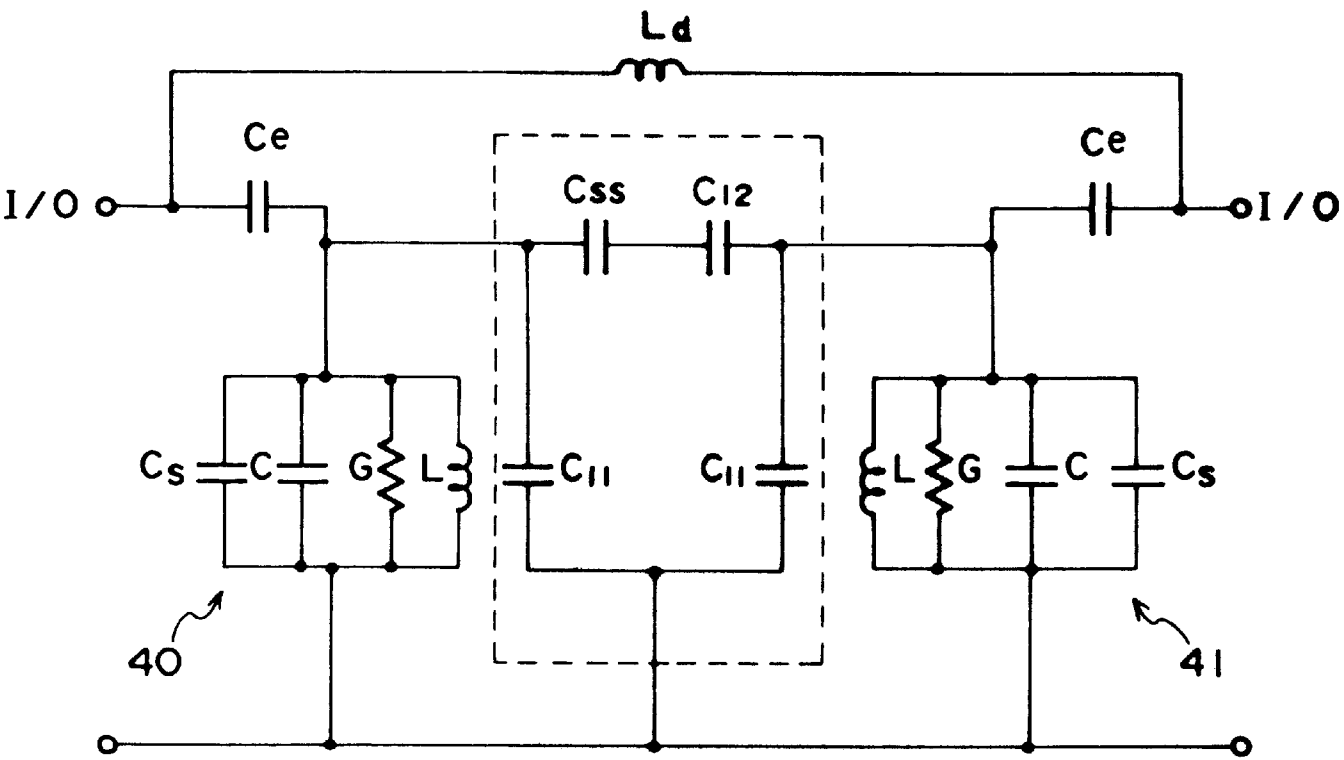
FIG. 8 is an equivalent circuit diagram of the band pass filter 1 shown in FIGS. 2 to 4.

FIG. 8 is an equivalent circuit diagram of the band pass filter 1 shown in FIGS. 2 to 4.

In this Figure, the first resonator 2 and the second resonator 3 are represented by two L-C parallel circuits 40 and 41, respectively. The resistances G are produced by the loss factor. Capacitances Cs are produced by the capacitive stub 16. The exciting electrodes 14 and 15 are represented by two capacitances Ce. The inductance Ld represents the direct coupling inductance between the exciting electrodes 14 and 15. The evanescent waveguide 4, which acts as an E-mode waveguide, produces a coupling capacitance C12 serially between the first resonator 2 and the second resonator 3 (internal coupling capacitance) and produces a pair of grounded shunt capacitances C11. A capacitance Css is also contributed by the capacitive stub, which acts as a series capacitance with C12.

Figure 9:
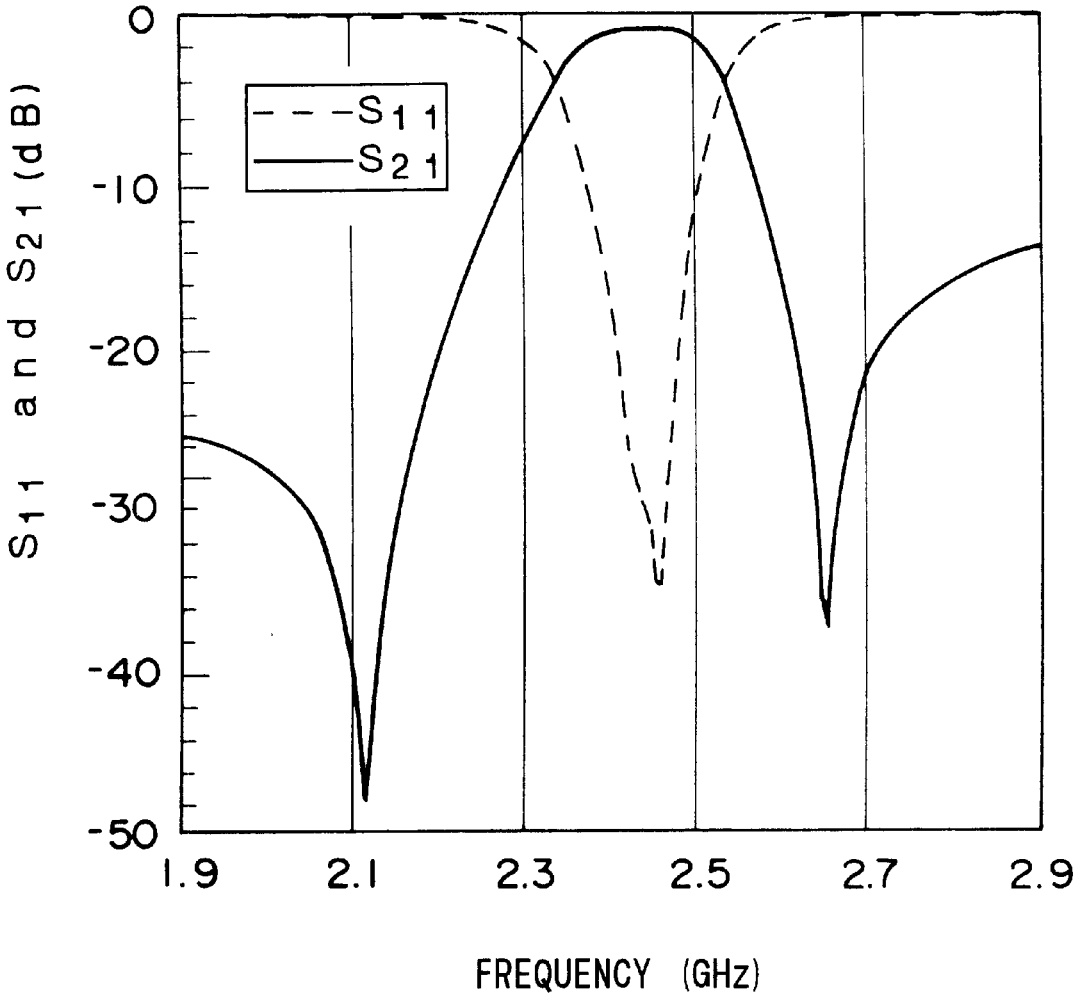
FIG. 9 is graph showing the frequency characteristic curve of the band pass filter 1 shown in FIGS. 2 to 4.

FIG. 9 is a graph showing the requency characteristic curve of the band pass filter 1 shown in FIGS. 2 to 4.

In this Figure, S11 represents a reflection coefficient, and S21 represents a transmission coefficient. As shown in FIG. 9, the resonant frequency of the band pass filter 1 is approximately 2.458 GHz and its 3-dB band width is approximately 200 MHz.

The function of the capacitive stub 16 of the band pass filter 1 will be explained.

As shown in FIG. 8, the capacitive stub 16 produces the capacitances Cs in parallel to the L-C parallel circuits 40 and 41 formed by the first resonator 2 and second resonartor 3. The resonant frequency of the band pass filter 1 is therefore made lower than if the capacitive stub 16 were not present. This means that the length of the band pass filter 1 can be shortened by adding the capacitive stub 16.

The resonant frequency of the first and second resonators 2 and 3 mainly depends on the length of the dielectric block as mentioned above, i.e., the resonant frequency increases with decreasing length of the dielectric block. The resonant frequency of the band pass filter 1 therefore also increases with decreasing length. The length of the band pass filter 1 is therefore univocally determined by the desired resonant frequency (2.458 GHz, for example). However, in the case where the capacitive stub 16 is added, because the resonant frequency is lowered compared with the resonant frequency determined by its length, the length of the band pass filter 1 can be shortened relative to that determined based on the desired resonant frequency.

Specifically, to obtain a quarter-wave (λ/4) dielectric resonator having a resonant frequency of approximately 2.458 GHz, the length of the dielectric block constituting the quarter-wave (λ/4) dielectric resonator would normally have to be set at approximately 3.55 mm. Therefore, if such a quarter-wave (λ/4) dielectric resonator were used as the first and the second resonators 2 and 3, the length of the band pass filter 1 would be 7.4 mm (3.55 mm×2+0.3 mm). However, according to this embodiment, because the capacitive stub 16 is employed in the band pass filter 1 to lower the resonant frequency, quarter-wave (λ/4) dielectric resonators of a length 2.95 mm can be used as the first and the second resonators 2 and 3 to obtain the above resonant frequency (approximately 2.458 GHz). The length of the band pass filter 1 is therefore shortened to 6.2 mm, as shown in FIGS. 2 to 4.

As described above, provision of the capacitive stub 16 reduces the size of the band pass filter 1.

The capacitance Cs produced by the capacitive stub 16 lowers the coupling constant k. This means that the thickness of the evanescent waveguide 4 can be increased by adding the capacitive stub 16.

Figure 10:
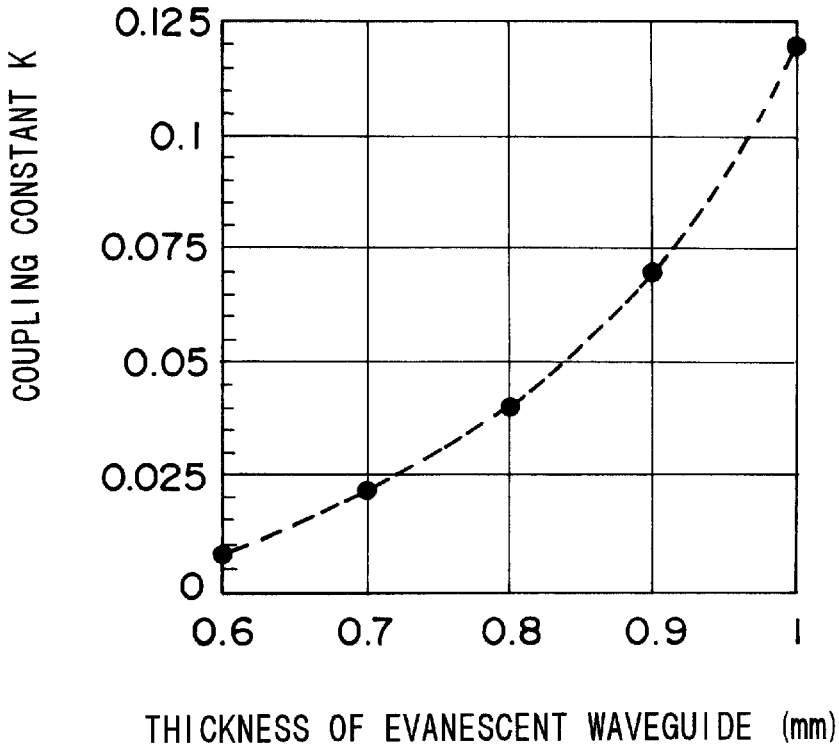
FIG. 10 is a graph showing the relationship between the thickness of an evanescent waveguide 4 and a coupling constant k

FIG. 10 is a graph showing the relationship between the thickness of the evanescent waveguide 4 and the coupling constant k. The width and length of the evanescent waveguide 4 are fixed at 2.4 mm and 0.3 mm.

As shown in FIG. 10, the coupling constant k exponentially increases with increasing thickness of the evanescent waveguide 4. The thickness of the evanescent waveguide 4 is therefore determined by the desired coupling constant k. For example, to obtain a coupling constant k of 0.058, the thickness of the evanescent waveguide 4 should be 0.86 mm, as shown in FIG. 10. On the other hand, because the evanescent waveguide 4 is disposed between the first and the second resonators 2 and 3, it is preferable that the evanescent waveguide 4 be thick enough to ensure the mechanical strength of the band pass filter 1.

In the case where the capacitive stub 16 is added to the band pass filter 1, however, because the coupling constant k is lowered compared with the value determined by the thickness of the evanescent waveguide 4, the thickness of the evanescent waveguide 4 to be set becomes great compared with the thickness determined from the desired coupling constant k.

Table 1 shows how coupling constant k and the resonant frequency vary with the height h of the capacitive stub 16 (BPF dimensions: 7.4 mm×2.4 mm×1.2 mm).

TABLE 1

| Height h of the capacitive stub 16 (mm) | Odd mode resonant frequency (GHz) | Even mode resonant frequency (GHz) | Coupling constant k |
|---|---|---|---|
| 0 | 2.422 | 2.567 | 0.058 |
| 0.4 | 2.421 | 2.550 | 0.052 |
| 0.6 | 2.387 | 2.489 | 0.042 |
| 0.8 | 2.316 | 2.388 | 0.036 |

Table 1 shows the coupling constant k at various heights h of a capacitive stub 16 of 4 mm width in the case of an evanescent waveguide 4 of 2.4 mm width, 0.3 mm length, and 0.86 mm thickness.

The "width" of the capacitive stub 16 is defined as that of its sides extending in the direction of the lengths of the first resonator 2, the second resonator 3, and the evanescent waveguide 4. The "height" of the capacitive stub 16 is defined as that of its sides extending in the direction of the thicknesses of the first resonator 2, the second resonator 3, and the evanescent waveguide 4.

As is apparent from Table 1, the coupling constant k decreases with increasing height h of the capacitive stub 16.

Specifically, while in the absence of the capacitive stub 16 (height h=0 mm), the thickness of the evanescent waveguide 4 would have to be 0.86 mm to obtain a band pass filter 1 having a coupling constant k of 0.058, according to this embodiment a thicker evanescent waveguide 4 of 1.0 mm thickness can be used to obtain the same coupling constant k because the band pass filter 1 employs the capacitive stub 16, whose height is 1.0 mm, to lower the coupling constant k The mechanical strength of the band pass filter 1 is therefore enhanced compared with the case where the capacitive stub 16 is not employed.

As set out above, the capacitive stub 16 enhances the mechanical strength of the band pass filter 1.

Table 1 also shows the resonant frequencies at various heights h of a capacitive stub 16 of 4 mm width.

As is apparent from Table 1, both the odd mode and the even mode resonant frequencies decreases with increasing height h of the capacitive stub 16. This means that the effective resonant frequency ((odd mode resonant frequency+even mode resonant frequency)/2) decreases with increasing height h of the capacitive stub 16.

Further, radiation loss is lowered because the capacitive stub 16 is formed at regions of the fourth side surfaces of the first and second resonators 2 and 3 where the electric field is strong.

Figure 11:
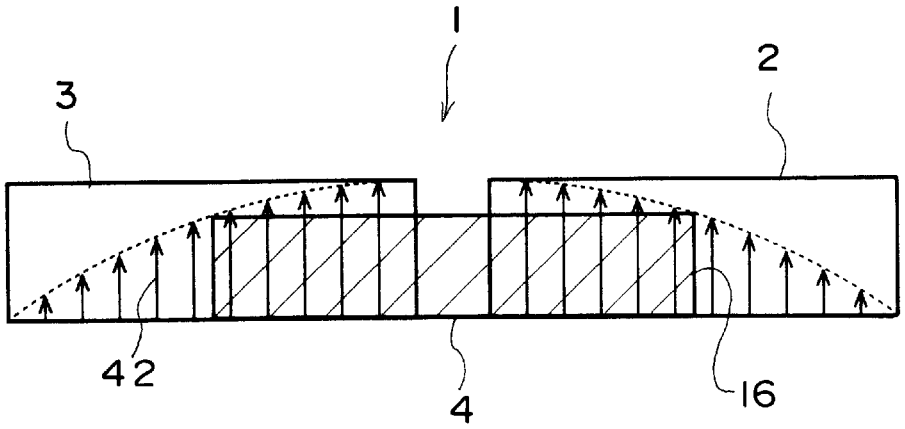
FIG. 11 is a schematic side view for explaining the relationship between an electric field generated by the band pass filter 1 shown in FIGS. 2 to 4 and a capacitive stub 16.

FIG. 11 is a schematic side view for explaining the relationship between the electric field generated by the band pass filter 1 shown in FIGS. 2 to 4 and the capacitive stub 16.

As is apparent from FIG. 11, the capacitive stub 16 is formed at a region of the fourth side surfaces of the first and second resonators 2 and 3 where the electric field 42 is strong. In the case where the capacitive stub 16 is not employed, relatively large radiation loss arises at the fourth side surfaces of the first and second resonators 2 and 3 because both of the fourth side surfaces are open to the air. However, in the case where the capacitive stub 16 is formed at the region of the fourth side surfaces of the first and second resonators 2 and 3 where the electric field is strong, the radiation loss is markedly lowered.

Further, the capacitive stub 16 widens the separation between the dominant mode resonant frequency and the higher mode resonant frequency. The effect of unnecessary higher mode resonation on the signal processed by the band pass filter 1 is therefore reduced.

As explained above, the band pass filter 1 of this embodiment achieves the foregoing various effects owing to the presence of the capacitive stub 16.

Another preferred embodiment of the present invention will now be explained.

Figure 12:
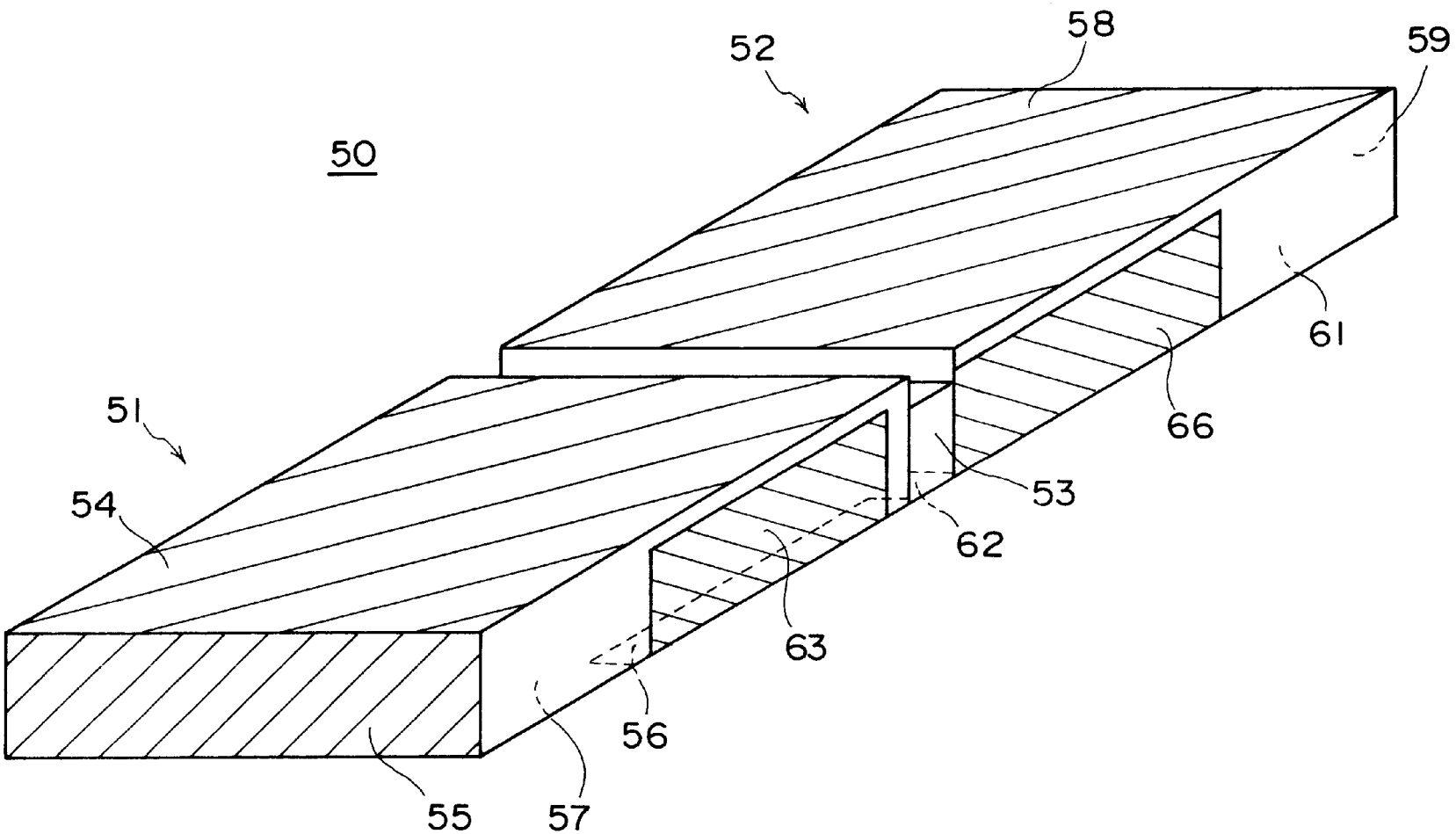
FIG. 12 is a schematic perspective view from one side showing a band pass filter 50 that is another preferred embodiment of the present invention.
Figure 13:
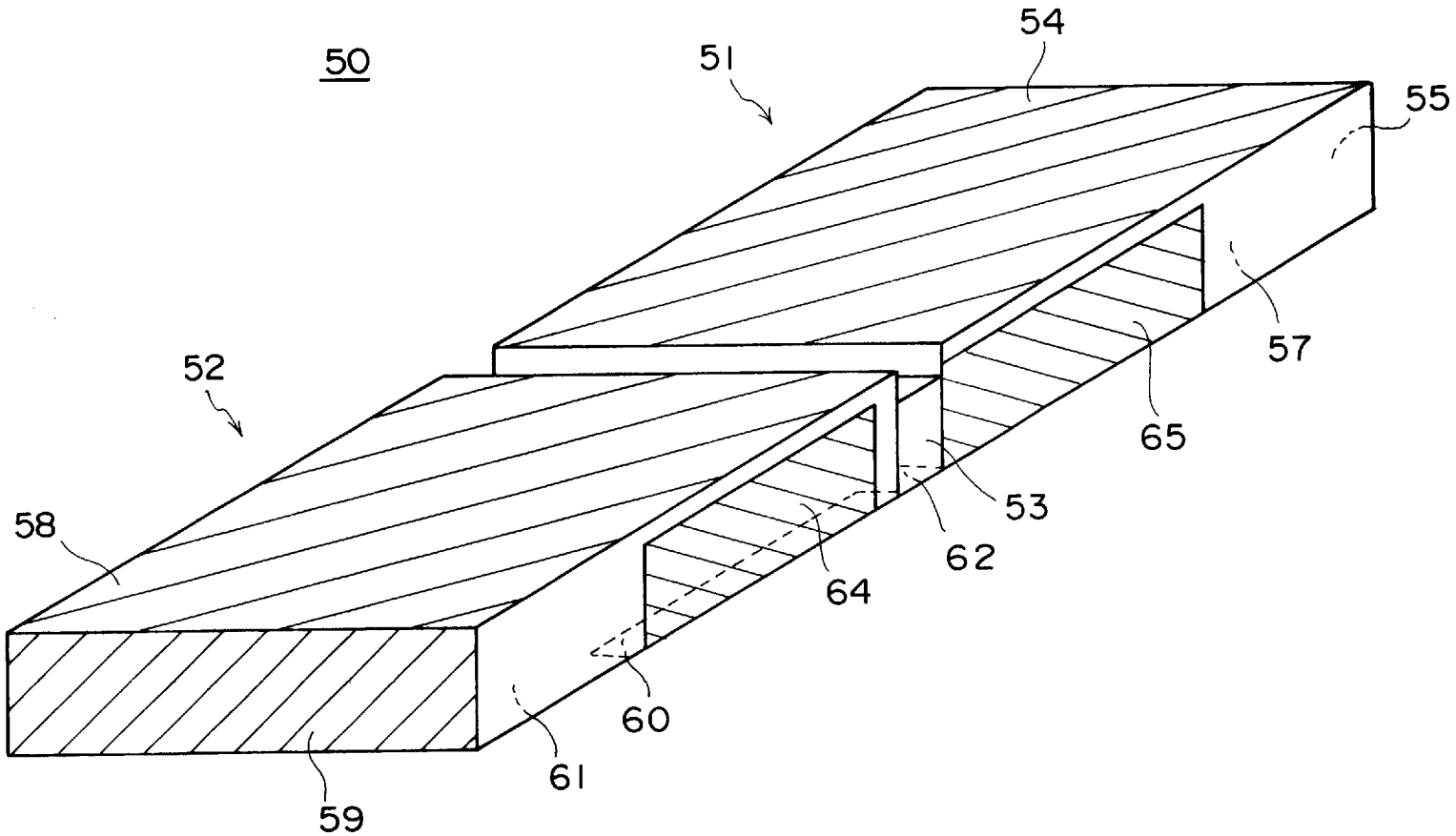
FIG. 13 is a schematic perspective view from the opposite side showing the band pass filter 50 of FIG. 12.

FIG. 12 is a schematic perspective view from one side showing a band pass filter 50 that is another preferred embodiment of the present invention. FIG. 13 is a schematic perspective view from the opposite side showing the band pass filter 50 of FIG. 12.

As shown in FIGS. 12 and 13, the band pass filter 50 that is another preferred embodiment of the present invention is constituted of a first resonator 51, a second resonator 52, and an evanescent waveguide 53 interposed between the first and second resonators 51 and 52. The overall sizes of the first and second resonators 51 and 52 and the evanescent waveguide 53 are the same as these of the first and second resonators 2 and 3 and the evanescent waveguide 4 of the band pass filter 1 of the embodiment described above. The dielectric blocks constituting the first and second resonators 51 and 52 and the evanescent waveguide 53 are made of dielectric material whose dielectric constant $\in r$ is relatively high, i.e., $\in r=93$, the same as in the band pass filter 1.

The top surfaces, bottom surfaces, first side surfaces, and second side surfaces of the dielectric blocks composing the first and second resonators 51 and 52, and the top surface, bottom surface, first side surface, second side surface, third side surface, and fourth side surface of the dielectric block composing the evanescent waveguide 53 are defined the same as the corresponding surfaces of the band pass filter 1 explained earlier. However, in the band pass filter 50 of this embodiment, the third surface of the dielectric block composing the first resonator 51, the fourth surface of the dielectric block composing the second resonator 52, and the third surface of the dielectric block composing the evanescent waveguide 53 are coplanar. The fourth surface of the dielectric block composing the first resonator 51, the third surface of the dielectric block composing the second resonator 52, and the fourth surface of the dielectric block composing the evanescent waveguide 53 are also coplanar.

As shown in FIGS. 12 and 13, metal plates 54 and 55 are formed on the entire top surface and entire second side surface of the first resonator 51; a metal plate 57 is formed on the bottom surface of the first resonator 51 expect at a clearance portion 56. These metal plates 54, 55, and 57 are short-circuited with one another. Similarly, metal plates 58 and 59 are formed on the entire top surface and entire second side surface of the second resonator 52; a metal plate 61 is formed on the bottom surface of the second resonator 52 except at a clearance portion 60. These metal plates 58, 59, and 61 are short-circuited with one another. A metal plate 62 is formed on the entire bottom surface of the evanescent waveguide 53. These metal plates 54, 55, 57, 58, 59, 61, and 62 are thus short-circuited with one another and grounded.

As shown in FIGS. 12 and 13, an exciting electrode 63 is formed on the third side surface of the first resonator 51 where the clearance portion 56 prevents the exciting electrode 63 from being in contact with the metal plate 57 formed on the bottom surface. Similarly, an exciting electrode 64 is formed on the third side surface of the second resonator 52 where the clearance portion 60 prevents the exciting electrode 64 from being in contact with the metal plate 61 formed on the bottom surface. One of the exciting electrodes 63 and 64 is used as an input electrode, and the other is used as an output electrode.

As shown in FIGS. 12 and 13, a first capacitive stub 65 is formed on the fourth side surface of the first resonator 51. The first capacitive stub 65 is connected to the metal plate 57 formed on the bottom surface of the first resonator 51. Similarly, a second capacitive stub 66 is formed on the fourth side surface of the second resonator 52. The second capacitive stub 66 is connected to the metal plate 61 formed on the bottom surface of the second resonator 52. The first capacitive stub 65 and the second capacitive stub 66 have the same dimensions.

Each of the first resonator 51 and the second resonator 52 having the above-described structure acts as a quarter-wave (λ/4) dielectric resonator. The evanescent waveguide 53 acts as an E-mode waveguide.

The band pass filter 50 having the above-described configuration has the same advantages as the band pass filter 1 of the embodiment described earlier. In addition, according to this embodiment, the fabrication cost can be lowered because the first resonator 51 and the second resonator have the same structure.

Another preferred embodiment of the present invention will now be explained.

Figure 14:
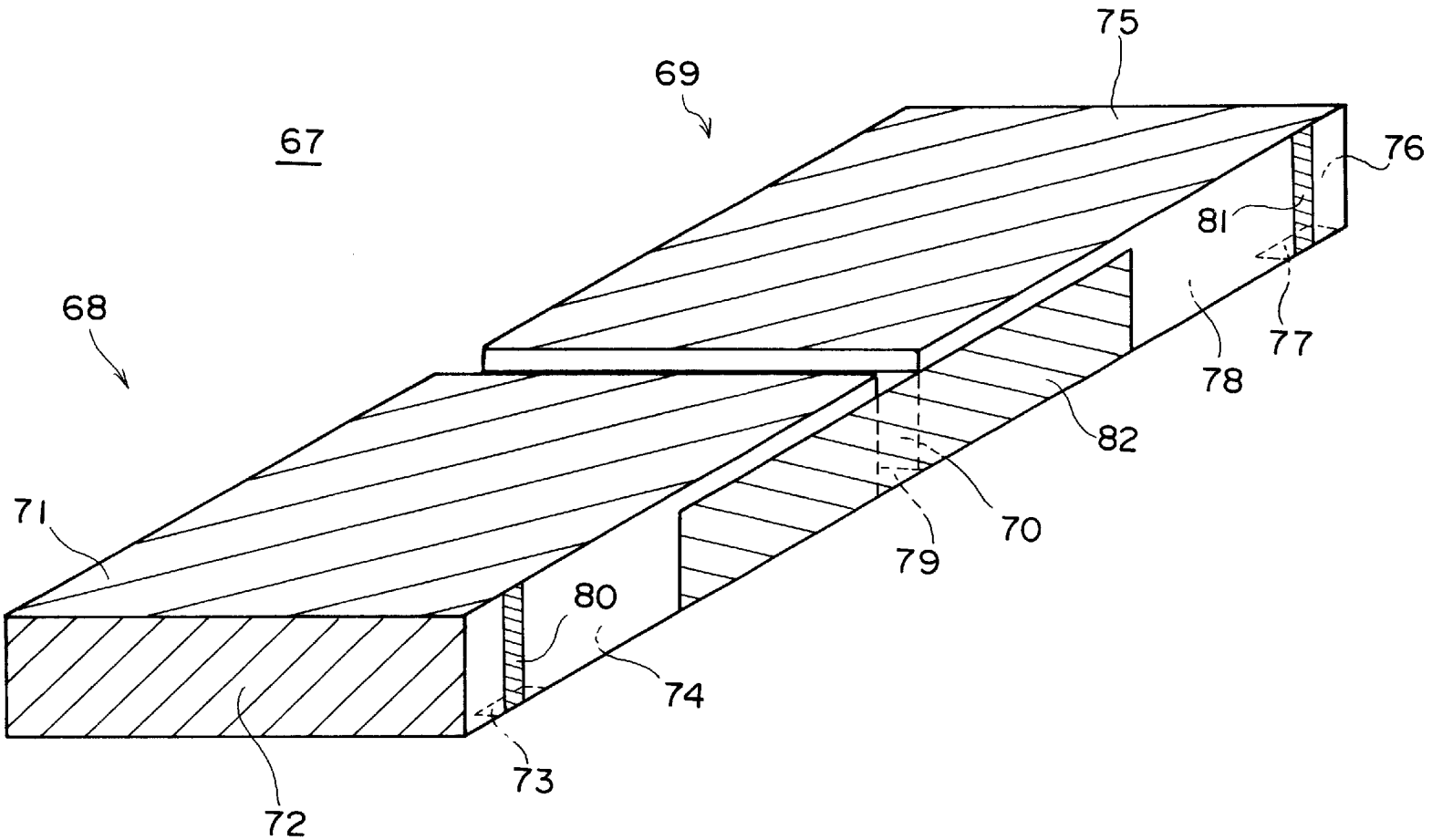
FIG. 14 is a schematic perspective view from one side showing a band pass filter 67 that is a further preferred embodiment of the present invention.
Figure 15:
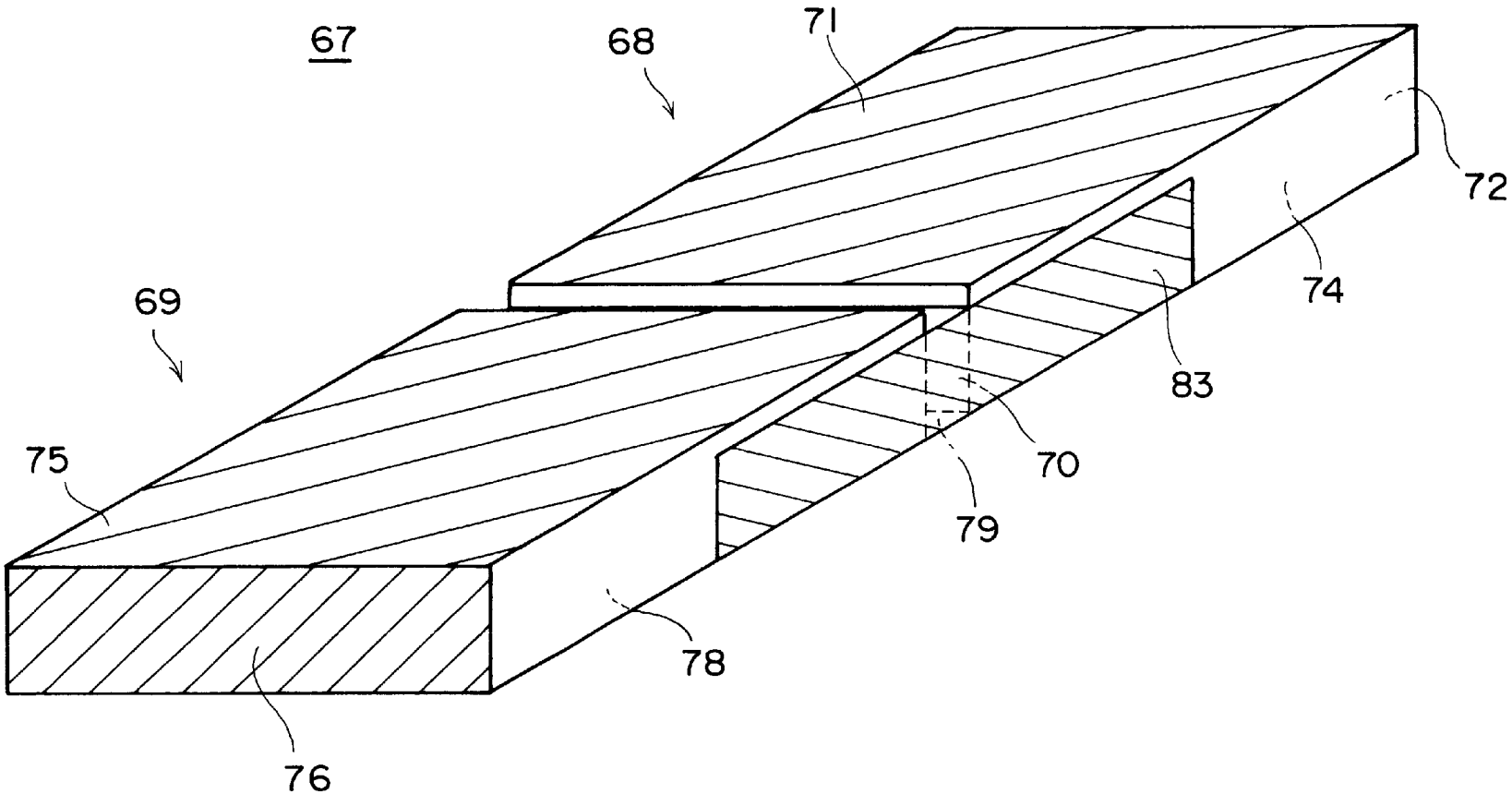
FIG. 15 is a schematic perspective view from the opposite side showing the band pass filter 67 of FIG. 14.

FIG. 14 is a schematic perspective view from one side showing a band pass filter 67 that is a further preferred embodiment of the present invention. FIG. 15 is a schematic perspective view from the opposite side showing the band pass filter 67 of FIG. 14.

As shown in FIGS. 14 and 15, the band pass filter 67 that is another preferred embodiment of the present invention is constituted of a first resonator 68, a second resonator 69, and an evanescent waveguide 70 interposed between the first and second resonators 68 and 69. The dielectric blocks constituting the first and second resonators 68 and 69 and the evanescent waveguide 70 are made of dielectric material whose dielectric constant ∈r is relatively high, i.e., ∈r=93, like the dielectric blocks constituting the first and second resonators 2 and 3 and the evanescent waveguide 4 of the band pass filter 1.

The top surfaces, bottom surfaces, first side surfaces, and second side surfaces of dielectric blocks composing the first and the second resonators 68 and 69, and the top surface, bottom surface, first side surface, second side surface, third side surface, and fourth side surface of the dielectric block composing the evanescent waveguide 70 are defined the same as the corresponding surface of the band pass filter 1 explained earlier. In the band pass filter 67 of this embodiment, as in the band pass filter 1, the third side surfaces of the first resonator 68, second resonator 69, and evanescent waveguide 70 are coplanar, and the fourth side surfaces of first resonator 68, second resonator 69, and evanescent waveguide 70 are also coplanar.

As shown in FIGS. 14 and 15, metal plates 71 and 72 are formed on the entire top surface and entire second side surface of the first resonator 68; and a metal plate 74 is formed on the bottom surface of the first resonator 68 except at a clearance portion 73. These metal plates 71, 72, and 74 are short-circuited with one another. Similarly, metal plates 75 and 76 are formed on the entire top surface and entire second side surface of the second resonator 69; and a metal plate 78 is formed on the bottom surface of the second resonator 69 except at a clearance portion 77. These metal plates 75, 76, and 78 are short-circuited with one another. A metal plate 79 is formed on the entire bottom surface of the evanescent waveguide 70. These metal plates 71, 72, 74, 76, 77, 78, and 79 are thus short-circuited with one another and grounded.

As shown in FIG. 14, an exciting electrode 80 is formed on the third side surface of the first resonator 68 where the clearance portion 73 prevents the exciting electrode 80 from being in contact with the metal plate 74 formed on the bottom surface. Similarly, an exciting electrode 81 is formed on the third side surface of the second resonator 69 where the clearance portion 77 prevents the exciting electrode 81 from being in contact with the metal plate 78 formed on the bottom surface. Exiting electrode 81 is connected with metal plate 75 and 80 connected with 71. One of the exciting electrodes 80 and 81 is used as an input electrode, and the other is used as an output electrode. The exciting electrodes 80 and 81 are inductive exciting electrodes whereas the exciting electrodes used in the above described embodiments are capacitive exciting electrodes.

As shown in FIGS. 14 and 15, a first capacitive stub 82, whose height is equal to that of the evanescent waveguide 70, is formed on the third side surfaces of the first resonator 68, second resonator 69, and evanescent waveguide 70. A second capacitive stub 83, whose height is equal to that of the evanescent waveguide 70, is formed on the fourth side surfaces of the first resonator 68, second resonator 69, and evanescent waveguide 70. The first and the second capacitive stubs 82 and 83 are in contact with the metal plates 74, 78, and 79 formed on the bottom surfaces of the first resonator 68, second resonator 69, and evanescent waveguide 70. Each of the first and the second capacitive stubs 82 and 83 is symmetrical with respect to the center of the evanescent waveguide 70 so that each part of the first and the second capacitive stubs 82 and 83 which is part of the first resonator 68 and another part of the first and the second capacitive stubs 82 and 83 which is part of the second resonator 69 have the same dimensions.

Each of the first resonator 68 and second resonator 69 having the above-described structure acts as a quarter-wave (λ/4) dielectric resonator. The evanescent waveguide 70 acts as an E-mode waveguide.

According to this embodiment, because the first and the second capacitive stubs 82 and 83 are formed on the third and fourth side surfaces, respectively, the effects produced by the capacitive stubs are more strongly obtained than in the case of the band pass filters 1 and 50. The overall size of the band pass filter 67 can be further reduced and the mechanical strength thereof can be further enhanced.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the dielectric blocks for the resonators and the evanescent waveguide are made of dielectric material whose dielectric constant ∈r is 93. However, a material having a different dielectric constant can be used according to purpose.

Further, the dimensions of the resonators and the evanescent waveguide specified in the above described embodiments are only examples. Resonators and an evanescent waveguide having different dimensions can be used according to purpose.

Furthermore, in the above-described embodiments, the resonators and the evanescent waveguide were explained as different components from one another. However, this does not mean that they must be physically different components, and it is instead possible to form a slit on the top surface of a single dielectric block to form two resonators and an evanescent waveguide interposed therebetween.

Further, the width of the capacitive stub 16 of the band pass filter 1 according to the above-described embodiment is set so that the opposite ends thereof are located at the center of the fourth side surfaces of the first and the second resonators 2 and 3. However, the width of the capacitive stub 16 can be wider or shorter than this. It is worth noting that the width of the capacitive stub 16 is preferably set so that each opposite ends thereof are located at the centers of the fourth side surfaces of the first and the second resonators 2 and 3. When the width of the capacitive stub 16 is shorter, various effects produced by the capacitive stub 16 are reduced. When the width of the capacitive stub 16 is wider the increase in conduction loss is greater than the increase in the various effects produced by the capacitive stub 16.

Figure 16:
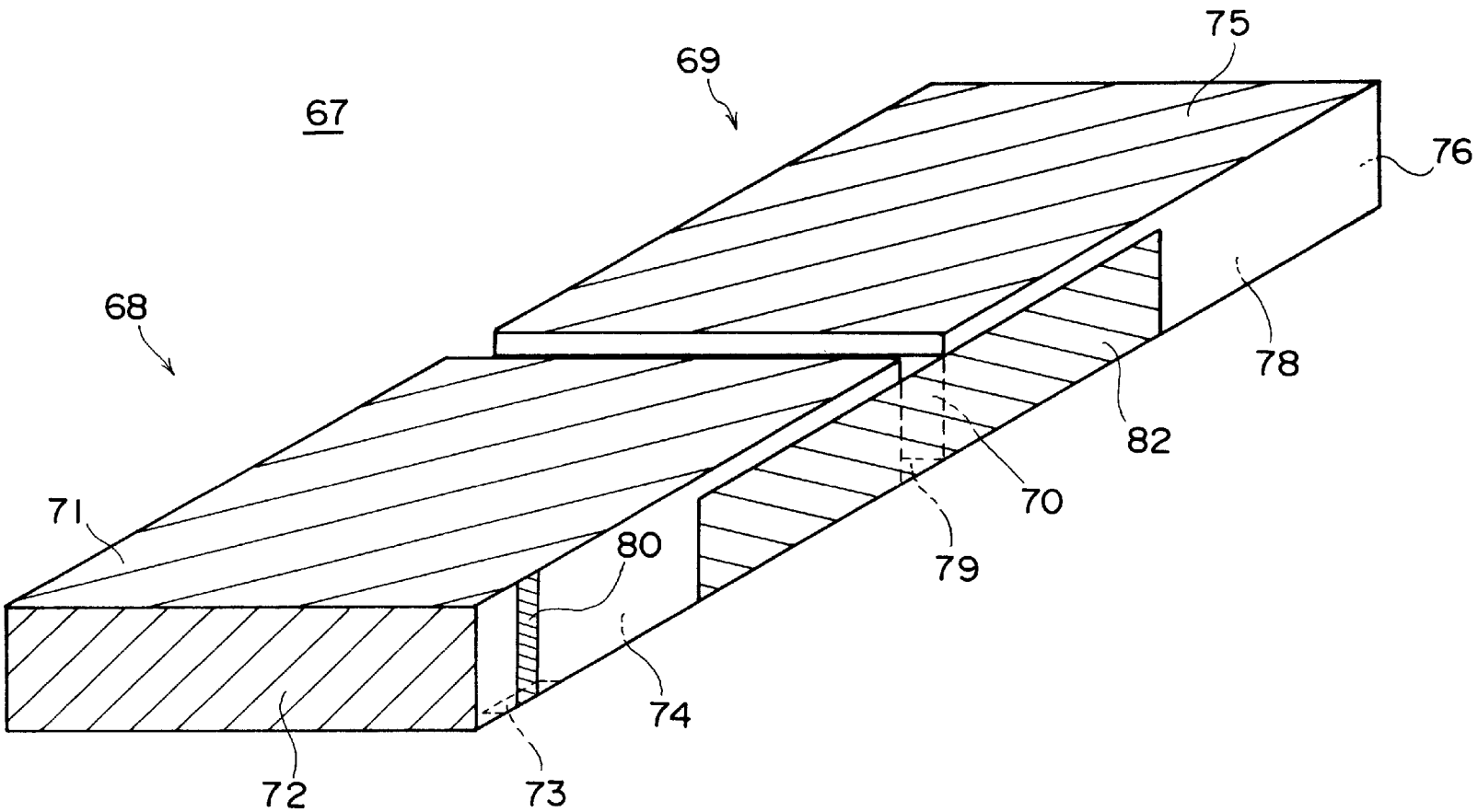
FIG. 16 is a schematic perspective view from one side showing an example in which exciting electrodes 80 and 81 are disposed on different sides of the band pass filter 67.
Figure 17:
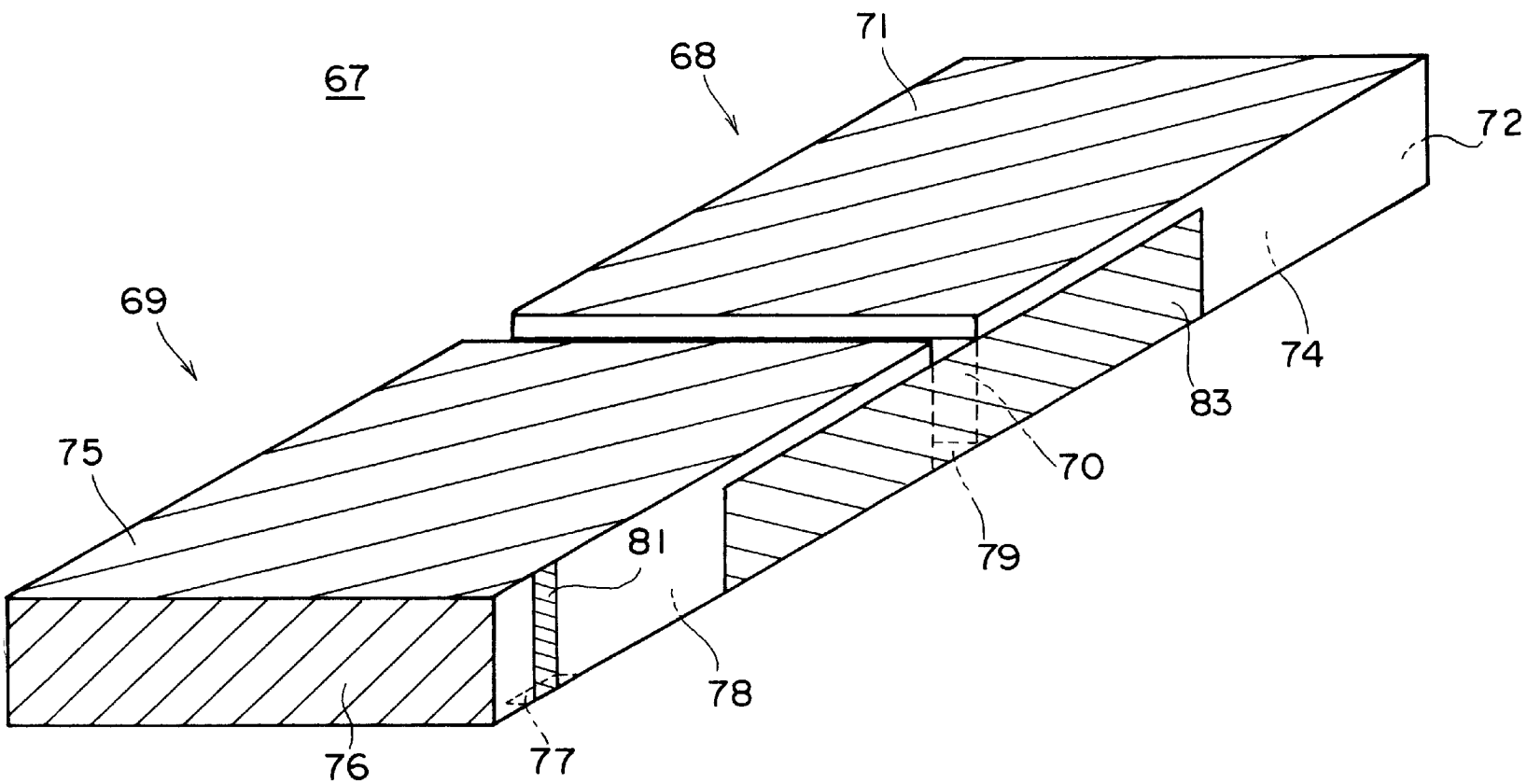
FIG. 17 is a schematic perspective view from the opposite side showing an example in which exciting electrodes 80 and 81 are disposed on different sides of the band pass filter 67.

Furthermore, the exciting electrodes 80 and 81 of the band pass filter 67 according to the above-described embodiment are disposed on the same side. However, they can be disposed on the different sides. An example in which the exciting electrodes 80 and 81 are disposed on the different sides of the band pass filter 67 is shown in FIGS. 16 and 17. FIG. 16 is a schematic perspective view from one side showing this example, and FIG. 17 is a schematic perspective view from the opposite side showing this example.

Figure 18:
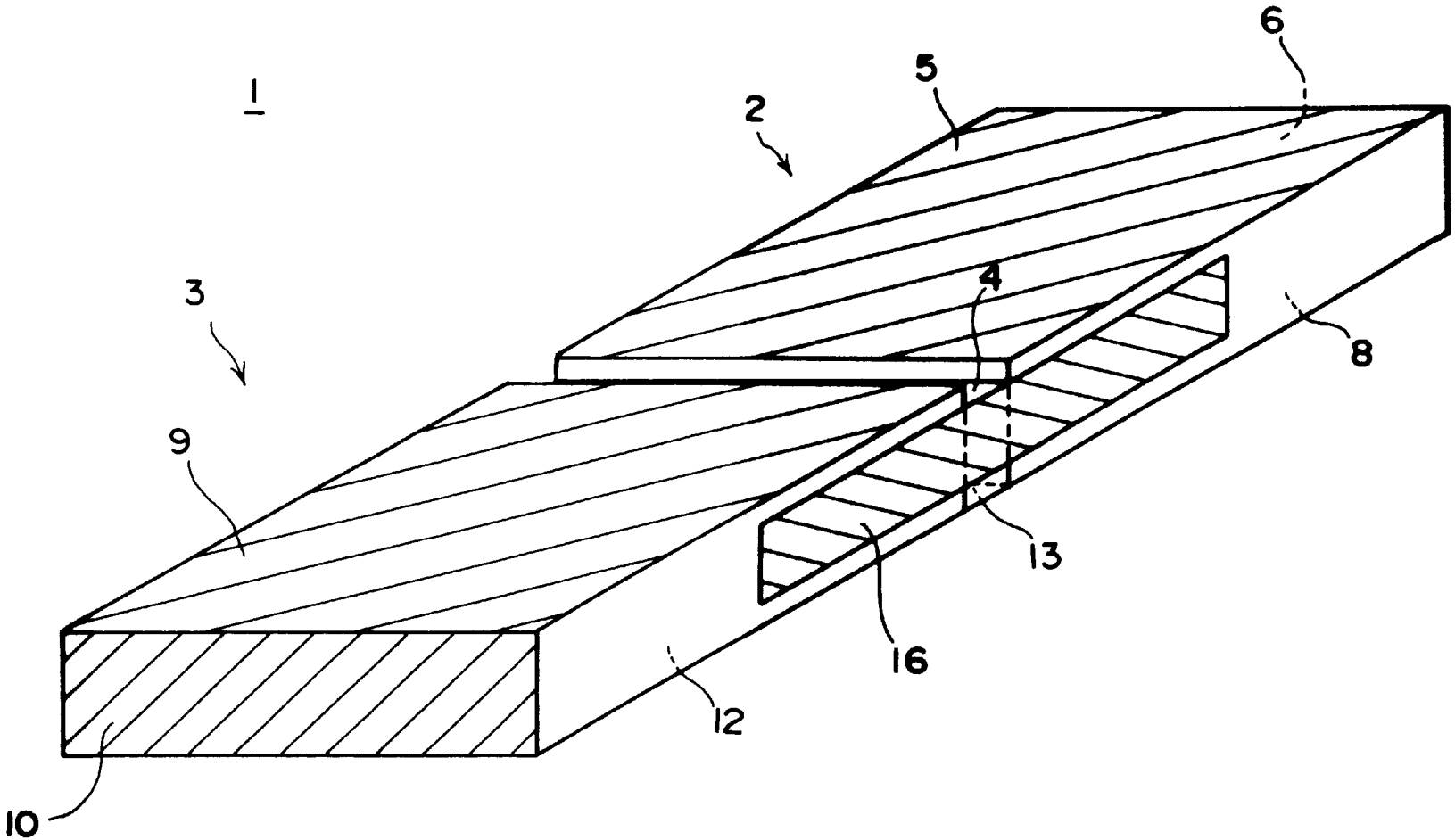
FIG. 18 is a schematic perspective view of the band pass filter 1 showing another example in which the capacitive stub 16 and metal plates 8, 12, and 13 formed on the bottom surfaces of a first dielectric block, a second dielectric block, and an evanescent waveguide are separated.

Further, in the above-described embodiments, the capacitive stubs are formed such that they are in contact with the metal plates formed on the first dielectric block, second dielectric block, and evanescent waveguide. However, the present invention is not limited to the capacitive stubs being in contact with the metal plates and they can be formed separately from the metal plates. An example in which the capacitive stub 16 and metal plates are formed separately in the band pass filter 1 is shown in FIG. 18. The above-described effects produced by the capacitive stub 16 can be obtained by such a configuration. It is worth noting that to obtain the effects efficiently it is preferable that the capacitive stubs and the metal plates be connected.

As described above, according to the present invention, because the band pass filter employs the capacitive stub, the overall size of the band pass filter can be reduced and the mechanical strength can be enhanced. Further, according to the present invention, the radiation loss arising at the side surfaces of the resonators of the band pass filter is reduced. Moreover, according to the present invention, the effect of the unnecessary higher mode resonation of the band pass filter can be reduced.

Therefore, the present invention provides a band pass filter that can be preferably utilized in communication terminals such as mobile phones and the like, LANs (Local Area Networks), and various communication devices used in ITS (Intelligent Transport Systems) and the like.

What is claimed is:

1. A band pass filter comprising: a first resonator having an input terminal formed on one side surface thereof, a second resonator having an output terminal formed on one side surface thereof, an evanescent waveguide interposed between the first and second resonators, and a capacitive stub having a first portion formed on another side surface of the first resonator and a second portion formed on another side surface of the second resonator.

2. The band pass filter as claimed in claim 1, further comprising a metal plate formed on a side surface of the evanescent waveguide, thereby connecting the first portion of the capacitive stub and the second portion of the capacitive stub.

3. The band pass filter as claimed in claim 1, wherein the first portion of the capacitive stub and the second portion of the capacitive stub have the same dimensions.

4. The band pass filter as claimed in claim 1, wherein the capacitive stub further has a third portion formed on the one side surface of the first resonator and a fourth portion formed on the one side surface of the second resonator.

5. A band pass filter comprising:

first and second dielectric blocks each of which has a top surface, a bottom surface, first and second side surfaces opposite to each other, and third and fourth side surfaces opposite to each other;

a third dielectric block in contact with the first side surface of the first dielectric block and the first side surface of the second dielectric block;

metal plates formed on the top surfaces, the bottom surfaces, and the second side surfaces of the first and second dielectric blocks;

a first electrode formed on the third side surface of the first dielectric block;

a second electrode formed on the third side surface of the second dielectric block;

a first capacitive stub formed on the fourth side surface of the first dielectric block; and a second capacitive stub formed on the fourth side surface of the second dielectric block.

6. The band pass filter as claimed in claim 5, wherein the first dielectric block and the second dielectric block have the same dimensions.

7. The band pass filter as claimed in claim 5, wherein the first capacitive stub is in contact with the metal plate formed on the bottom surface of the first dielectric block, and the second capacitive stub is in contact with the metal plate formed on the bottom surface of the second dielectric block.

8. The band pass filter as claimed in claim 5, wherein the first capacitive stub and the second capacitive stub have the same dimensions.

9. The band pass filter as claimed in claim 5, wherein the third dielectric block has a first side surface in contact with the first side surface of the first dielectric block, a second side surface in contact with the first side surface of the second dielectric block, a third side surface parallel to the third side surface of the first dielectric block, a fourth side surface parallel to the fourth side surface of the first dielectric block, a top surface parallel to the top surface of the first dielectric block, and a bottom surface parallel to the bottom surface of the first dielectric block on which a metal plate is formed.

10. The band pass filter as claimed in claim 9, wherein the bottom surfaces of the first to third dielectric blocks are coplanar.

11. The band pass filter as claimed in claim 9, wherein the third side surface of the first dielectric block and the third side surface of the third dielectric block are coplanar, and the fourth side surface of the first dielectric block and the fourth side surface of the third dielectric block are coplanar.

12. The band pass filter as claimed in claim 5, wherein the third side surface of the first dielectric block and the third side surface of the second dielectric block are coplanar, and the fourth side surface of the first dielectric block and the fourth side surface of the second dielectric block are coplanar.

13. The band pass filter as claimed in claim 12, wherein a metal plate is formed on the fourth side surface of the third dielectric block thereby integrating the first capacitive stub, the second capacitive stub, and the metal plate formed on the fourth side surface of the third dielectric block.

14. The band pass filter as claimed in claim 5, wherein the third side surface of the first dielectric block and the fourth side surface of the second dielectric block are coplanar, and the fourth side surface of the first dielectric block and the third side surface of the second dielectric block are coplanar.

15. The band pass filter as claimed in claim 5, further comprising a third capacitive stub formed on the fourth side surface of the first dielectric block and a fourth capacitive stub formed on the fourth side surface of the second dielectric block.

16. The band pass filter as claimed in claim 15, wherein the first electrode is in contact with the metal plate formed on the top surface of the first dielectric block, and the second electrode is in contact with the metal plate formed on the top surface of the second dielectric block.

17. The band pass filter as claimed in claim 5, wherein the first dielectric block and the metal plates formed on the top surface, bottom surface and second side surface thereof constitute a quarter-wave ($\lambda/4$) dielectric resonator, and the second dielectric block and the metal plates formed on the top surface, bottom surface and second side surface thereof constitute another quarter-wave ($\lambda/4$) dielectric resonator.

18. The band pass filter as claimed in claim 5, wherein an end of the first capacitive stub is positioned at a center of the fourth side surface of the first dielectric block, and an end of the second capacitive stub is positioned at a center of the fourth side surface of the second dielectric block.

* * * * *